US005516990A

United States Patent [19]

Anselm et al.

[11] Patent Number: 5,516,990

[45] Date of Patent: May 14, 1996

[54] ENGINE INCOMING AIR SILENCER AND MOUNTING ARRANGEMENT THEREFORE

[75] Inventors: Michael C. Anselm, Fort Myers, Fla.; Edward K. Lam, Wadsworth; James S. Nerstrom, Green Oaks, both of Ill.

[73] Assignee: Outboard Marine Corporation, Waukegan, Ill.

[21] Appl. No.: 255,336

[22] Filed: Jun. 7, 1994

[51] Int. Cl.[6] ..... F02M 35/00

[52] U.S. Cl. ..... 181/229

[58] Field of Search ..... 181/229, 235, 181/238, 240, 249, 251, 255, 269, 282; 123/195 C, 198 E

[56] References Cited

U.S. PATENT DOCUMENTS

| | | | |
|---|---|---|---|
| 3,810,526 | 5/1974 | Kawasaki | 181/229 |
| 3,835,956 | 9/1974 | Kishira | 181/229 |
| 4,093,039 | 6/1978 | Moore et al. | 181/229 |
| 4,620,607 | 11/1986 | Breckenfeld et al. | 181/229 |

*Primary Examiner*—Khanh Dang
*Attorney, Agent, or Firm*—Michael, Best & Friedrich

[57] ABSTRACT

Disclosed herein is an air silencer comprising a main body including a first member including a first wall partially defining a first plenum area, a second wall partially defining a second plenum area, and a third wall connecting the first and second walls, a second member including a first wall which partially defines a plenum area cooperating with the first plenum area of the first member to define a first plenum chamber, a second wall which partially defines a plenum area cooperating with the second plenum area of the first member to define a second plenum chamber, and a third wall which connects the first and second walls of the second member and is located in spaced relation to the third wall of the first member to define therebetween a narrow passage between the first and second plenum chambers.

10 Claims, 3 Drawing Sheets

ENGINE INCOMING AIR SILENCER AND MOUNTING ARRANGEMENT THEREFORE

BACKGROUND OF THE INVENTION

The invention relates generally to internal combustion engines and to air silencers for relieving noise emissions associated with the inrush of air into the engine.

The invention also relates to arrangements for attaching such air silencers to an internal combustion engine.

Attention is directed to U.S. Pat. No. 4,620,607 issued Nov. 14, 1986.

SUMMARY OF THE INVENTION

The invention provides an air silencer for supplying combustion air to the air intake tube of a carburetor, which silencer comprises a first plenum chamber including an opening adapted to communicate with the air intake tube, a second plenum chamber including a plurality of air supply tubes adapted to communicate with the atmosphere, and a narrow passage extending between and communicating with the first and second plenums.

The invention provides an air silencer for supplying combustion air to the air intake tubes of a series of carburetors, which silencer comprises a main body including a first plenum chamber including a series of openings equal in number to the number of air intake tubes and being adapted communicate with the air intake tubes, a second plenum chamber including a plurality of air supply tubes adapted to communicate with the atmosphere, and a narrow passage extending between and communicating with the first and second plenums.

The invention also provides an air silencer comprising a main body including a first member including a first wall partially defining a first plenum area, a second wall partially defining a second plenum area, and a third wall connecting the first and second walls, a second member including a first wall which partially defines a plenum area cooperating with the first plenum area of the first member to define a first plenum chamber, a second wall which partially defines a plenum area cooperating with the second plenum area of the first member to define a second plenum chamber, and a third wall which connects the first and second walls of the second member and is located in spaced relation to the third wall of the first member to define therebetween a narrow passage between the first and second plenum chambers.

Other features and advantages of the invention will become known by reference to the following general description and claims and the accompanying drawings.

Figure 1:
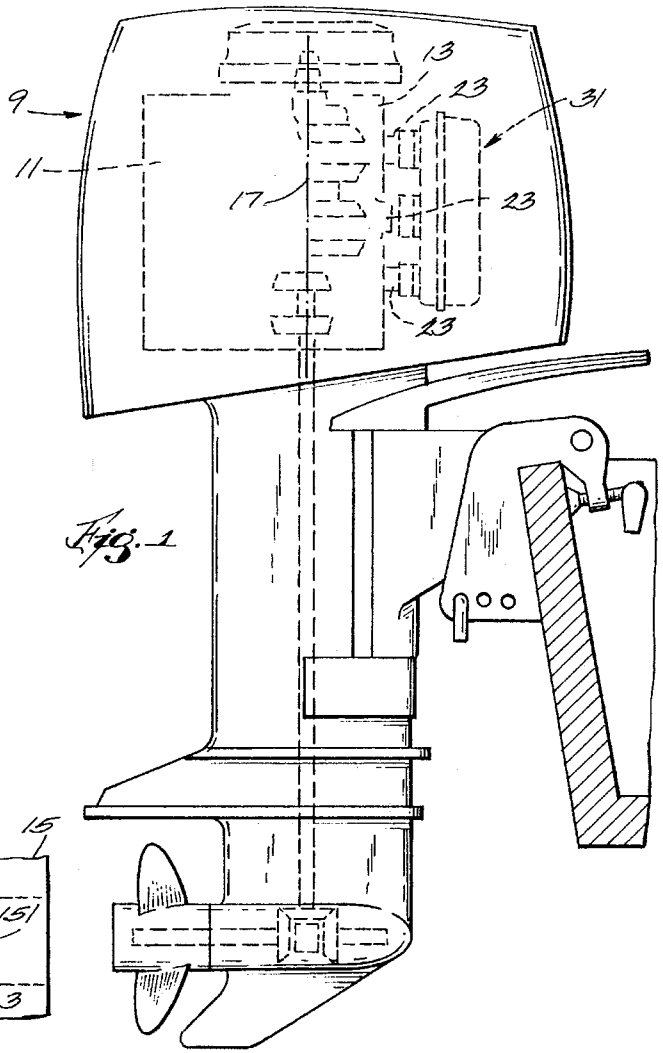
FIG. 1 is a side elevational view of an outboard motor incorporating an air silencer and embodying various of the features of the invention.
Figure 11:
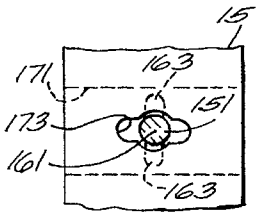
FIG. 11 is a fragmentary sectional view taken along line 11—11 of FIG. 9.

Before one embodiment of the invention is explained in detail, it is to be understood that the invention is not limited to the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Figure 3:
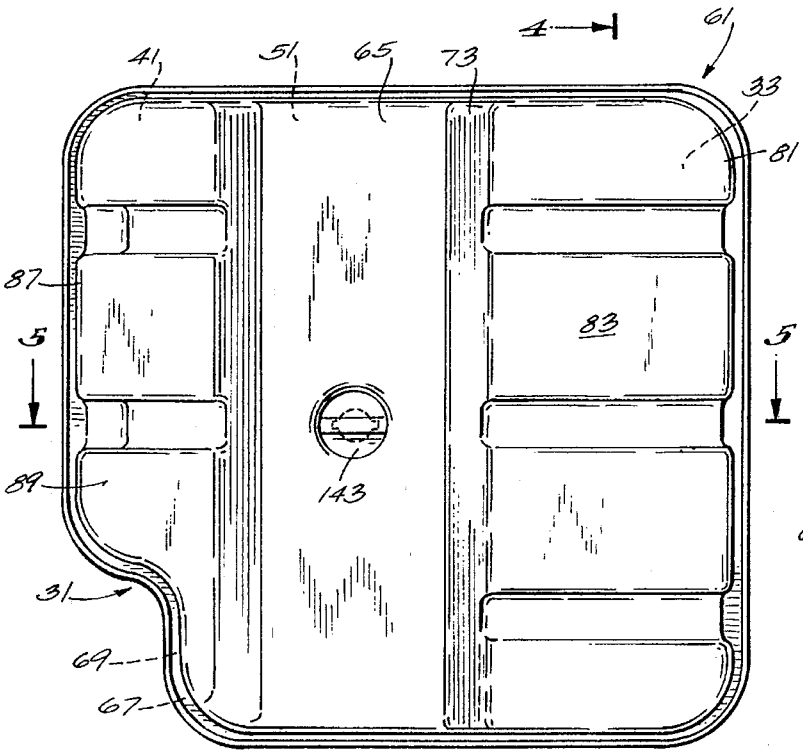
FIG. 3 is a front elevational view of the air silencer shown in FIG. 2.
Figure 2:
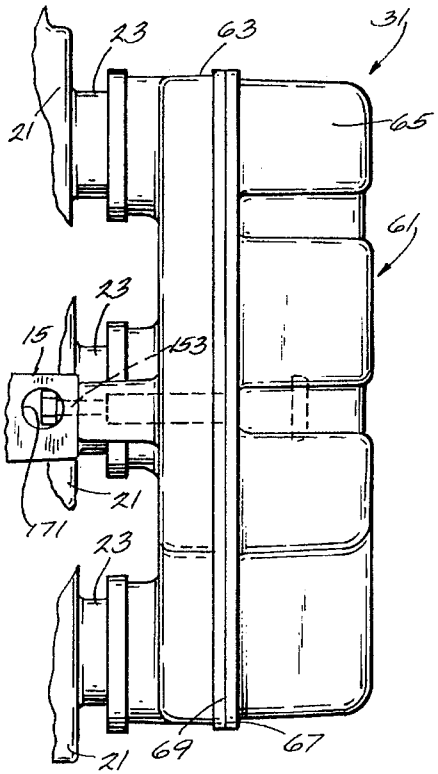
FIG. 2 is an enlarged fragmentary side elevational view of a portion of the outboard motor which is shown in FIG. 1, which portion includes the air silencer.

Shown in the drawings i.e. an outboard motor 9 comprising an engine cylinder block 11 including a crank case cover 13 provided with (see FIG. 3) a mounting post 15 extending radially and forwardly with respect to the crankshaft axis 17.

Also supported by the engine cylinder block 11 is a series of carburetors 21 respectively including air induction tubes 23 which are vertically aligned and have entry ends 25 in a common plane. While any number of carburetors could be employed, in the disclosed construction, there are three carburetors 21.

Releasably supported on the mounting post 15 is an air silencer 31 adapted to enable a flow of combustion air from the atmosphere to the air intake tubes 23 of the carburetors 21, while at the same time, effectively silencing the noise associated with air flow to and through such air induction tubes 23.

The air silencer 31 includes (see FIG. 5) a first plenum chamber 33, and a series of openings 35 which are equal in number to the air induction tubes 23, which communicate with the first plenum chamber 33, and which are telescopically engaged over the ends of the air induction tubes 23 when the air silencer 31 is mounted on the engine cylinder block 11. The first plenum chamber 33 is preferably large enough to obtain smooth air flow into the air induction tube 23.

The air silencer 31 also includes (see FIG. 5) a second plenum 41 located in laterally spaced relation to the first plenum 33, and a series of air supply tubes 43 which communicate between the atmosphere and the second plenum 41. In addition, the air silencer 31 includes a narrow passage 51 extending between the first and second plenums 33 and 41.

Figure 6:
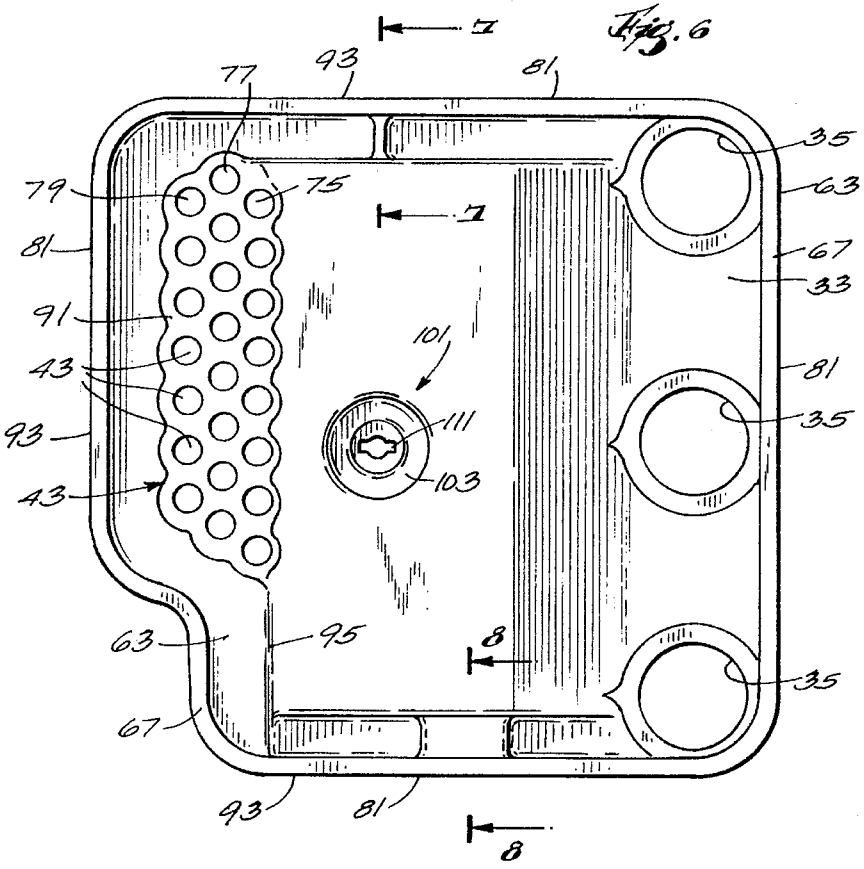
FIG. 6 is a sectional view taken along line 6—6 of FIG. 5.

More particularly, the air silencer 31 includes a main body or housing 61 which is formed by first and second members 63 and 65 which are preferably fabricated of plastic and which are permanently secured to each other. In this regard, the first member 63 defines the series of openings 35 and the air supply tubes 43. In addition, the first member 63 also includes first and second walls 64 and 91, 93, 95, which are hereinafter described in greater detail and which respectively define first and second pleunum areas 68 and 70 which partially defines the first and second plenums 33 and 41. The first member 63 also includes a third wall 71 which partially defines the narrow passage 51. The first member 63 and also includes (see FIG. 6) a peripheral, generally rectangular mating face 67.

The second member 65 includes first and second walls 81, 83 and 87, 89 which are hereinafter described in grater detail and which respectively define plenum areas 76 and 78 which cooperate with the plenum areas 68 and 70 to complete definition of the first and second plenum chambers 33 and 41 In addition, the second member 65 also includes a third wall 73 which partially defines the narrow passage 51. The second member 65 and also includes a peripheral generally rectangular mating face 69 which mates with and is fixed to the mating face 67 of the first member 63.

In the disclosed construction, the narrow passage 51 extends vertically from the top to the bottom of the housing or main body 61 and is defined, as already indicated, in the first and second members 63 and 65, by respective third walls or wall portions 71 and 73. In the disclosed construction, the wall portions 71 and 73 are slightly oppositely convex. However, if desired, the opposing wall portions 71 and 73 could be generally parallel. The wall portions 71 and 73 are spaced from each other at approximately the same distance as the spacing between the inner ends of the air supply tubes 43 and the opposite wall of the second plenum 41. While other constructions could be employed, in the disclosed construction the spacing between the inner ends of the air supply tube 43 and the opposing wall is about ¼ inch.

The openings 35 are vertically aligned and extend, in series, from the top to the bottom of the main body or housing 61.

The air supply tubes 43 are arranged in first, second and third vertical rows 75 77 and 79 and, as a group, extend from adjacent the top of the housing or main body 61 and downwardly for about two thirds of the distance between the top and bottom of the main body or housing 61. Each air supply tube 43 can be cylindrical in shape. However, in order to facilitate molding from plastic and to locate the tubes in relatively closely nested relation, the tubes in the first and third rows 75 and 79 are somewhat tapered with the larger end of the tubes 43 being located at the atmospheric side of the main body or housing 61 and the tubes in the second row 75 are tapered in the opposite direction and are arranged so that the larger end is located adjacent the second plenum 41.

While other constructions can be employed, in the disclosed construction, the air supply tubes are about ⅜" in diameter and the length thereof should be at least twice the diameter and preferably greater than twice the diameter. The total open area of the air supply tubes 43 is preferably about ⅔ of the areas of the throttle valves in the air induction tubes.

The first plenum chamber 33 is principally defined by the second member 65 and is formed by an outer wall 81 which extends from the openings 35, from the mating face 69, and along the four sides of the second member 65, and by a generally flat wall 83 which extends from the outer wall 81, which extends generally parallel to the mating face 69 and from the top to the bottom of the main body housing 61, and which merges with the wall portion 73 forming the narrow passage 51 and located above the mating face 67, i.e., within the recess formed by the outer wall 81 and the generally flat wall 83 of the second member 65.

The second plenum chamber 41 is also principally defined by the second member 65 and includes an outer wall 87 extending from the mating face 69 and a flat wall 89 extending from the outer wall 87 and from the top to [he bottom of the main body or housing 61.

In the first member 63 the outer ends of the air supply tubes 43 lie in a planer wall 91 which extends from and merges with an outer wall 93 extending from the mating face 67. In addition, the second plenum 41 is formed by a wall 95 extending upwardly from the wall portion 71 in adjacent relation to the first row 75 of air supply tubes 43, which wall 95 also extends below the row 75 of tubes 43 to the outer wall 93.

Figure 8:
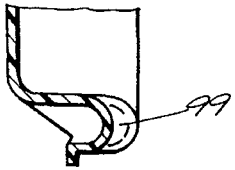
FIGS. 7 and 8 are fragmentary sectional views taken along lines 7—7 and 8—8 of FIG. 6.
Figure 7:
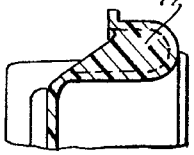

As shown in FIGS. 7 and 8, the first and second plenum chambers 33 and 41 are prevented from communicating with each other, except through the narrow passage 51, by blocking walls 97 and 99.

Figure 10:
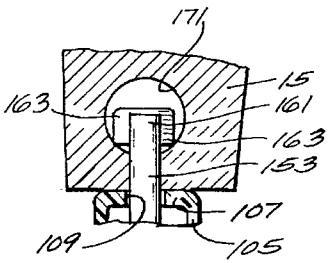
FIG. 10 is a fragmentary sectional view taken along line 10—10 of FIG. 9.
Figure 5:
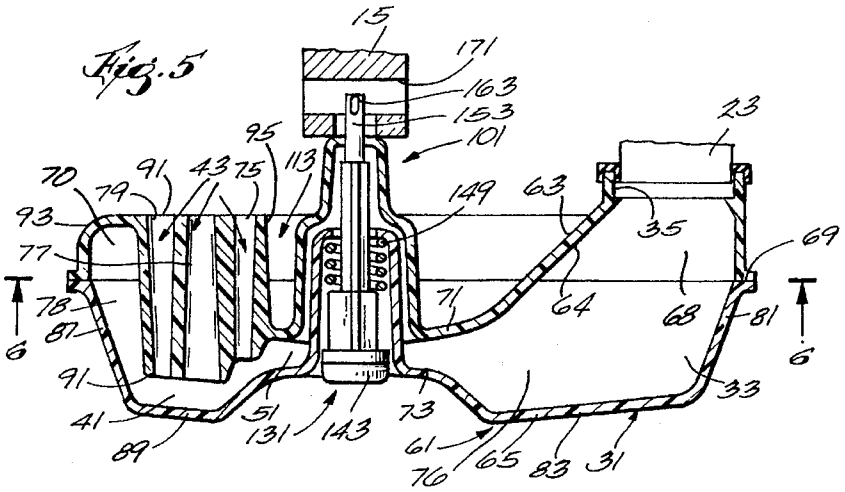
FIG. 5 is a fragmentary sectional view taken along line 5—5 of FIG. 3.

Means are provided for releasably attaching the air silencer 31 to the crankcase cover 13 of the engine cylinder block 11. While other arrangements can be employed, the disclosed arrangement includes telescopic engagement of the openings 35 with the ends of the air induction tubes 23 and connection of the main body or housing 61 to the mounting post 15 of the crankcase cover 13 of the engine cylinder block 11. In this regard, the first member 63 includes, as shown in FIG. 5, a hollow mounting projection 101 which extends outwardly from the wall portion 71 defining the narrow passage 51 and which includes a larger, cylindrical, hollow, base portion 103, and an outer cylindrical hollow extension portion 105 which is of lesser diameter and which includes (see FIG. 10) an outer transverse wall 107 including a central opening 109 having two radially extending slotted portions 111.

In order to prevent effective communication between the narrow passage 51 and the mounting projection 101 of the first member 63, the second member 65 includes a cylindrical projection 115 which extends from the wall portion 73 defining the narrow passage 51 in the direction toward the first member 63 and into the base portion 103 of the mounting projection 101 in either loosely fitting or closely fitting telescopic relation thereto to prevent airflow there between. Thus, the projection 115 extending from the second member 65 provides or constitutes a cylindrical recess 117 in the wall portion 73 of the second member 65.

Figure 12:
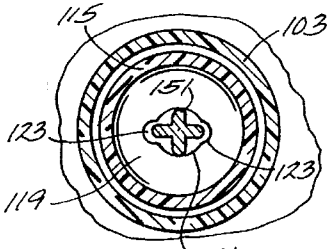
FIG. 12 is a fragmentary sectional view taken along line 12—12 of FIG. 9.

The outer end of the second member projection 115 is defined (see FIG. 12) by a transverse wall 119 having therein a central aperture 121 which includes two radially extending slots 123 in alignment with the slots 111.

In addition, the engagement of the cylindrical projection 115 of the second member 65 and the mounting projection 101 of the first member 63 serves to strengthen and rigidify the main body or housing 61 and to provide a mounting assembly 113.

Figure 9:
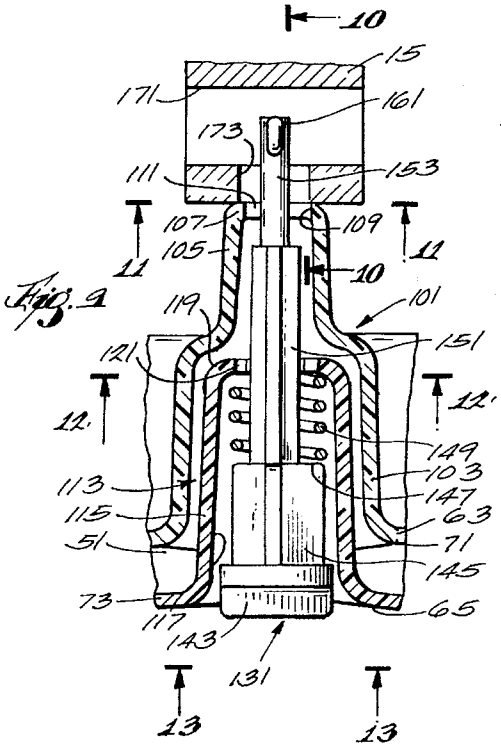
FIG. 9 is an enlarged fragmentary view of the arrangement for mounting the air silencer shown in FIG. 2 on the engine included in the outboard motor shown in FIG. 1.
Figure 13:
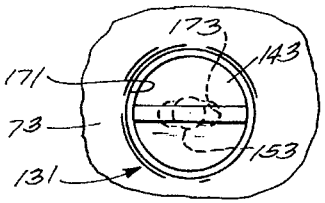
FIG. 13 is a fragmentary sectional view taken along line 13—13 of FIG. 9.
Figure 4:
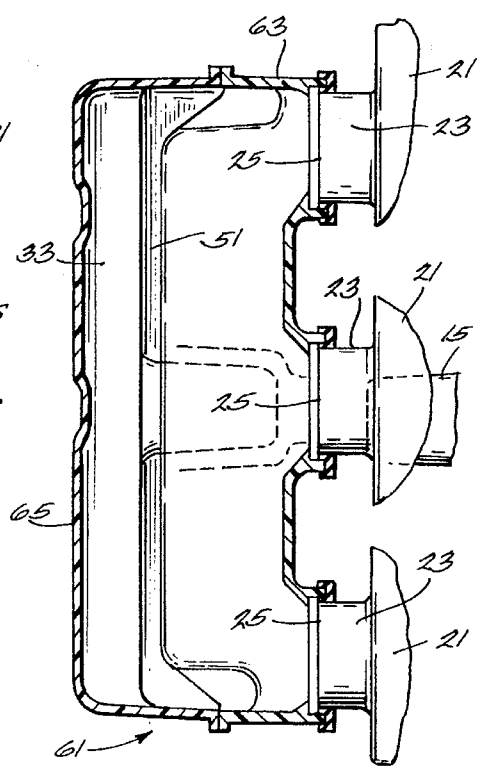
FIG. 4 is a fragmentary sectional view taken along line 4—4 of FIG. 3.

The main body 61 of the air silencer 31 is connected (see FIG. 9) to the mounting post 15 by a latch member 131 which extends through the cylindrical recess 117 in the cylindrical projection 115 of the second member 65 and through the openings 109 and 121 in the ends of the mounting projection 101 and the cylindrical projection 115 and into an opening 141 in the mounting post 15.

More particularly, the latch member 131 includes, in series, an outer head 143 adapted to be grasped by an operator, an adjacent portion 145 which is reduced in size as compared to the head 143 and provides a shoulder 147 for a helical biasing spring 149 still to be described, a central elongated portion 151 of still lesser cross sectional area to assist in defining the shoulder 147, and a still further end portion 153 which is of further reduced size and which has a bayonet end 161 including two wings, tabs, or extensions 163 projecting outwardly in opposite directions.

The mounting post 15 on the crankcase cover 13 of the cylinder block 11 includes an opening 171 which is transverse to the radial projection of the mounting post 15 and a radially extending bayonet opening 173 which communicates between the outer most end surface of the mounting post 15 and the transverse opening 171, and which is of the same shape but slightly larger than the bayonet end 161 of the latch member 131.

The main body or housing 61 of the air silencer 31 is releasably attached to the crankcase cover 13 by extending the latch member 131 through the cylindrical recess 117, through the openings 121 and 109 in the cylindrical projection 115 and the mounting projection 101, and through the opening 173 in the mounting post 15. The latch member 131 is then partially rotated to place the extensions or wings 163 thereof into abutting engagement with the wall of the transverse opening 171, thereby preventing removal of the latch member 131 from the opening 173 in the mounting post 15 in the absence of return rotation to the position affording passage of the bayonet end 161 of the latch member 131 through the opening 173 in the mounting post 15.

The bayonet end 161 of the latch member 131 is biased into engagement with the wall of the transverse opening 171 in the mounting post 15 and, at the same time, the end of the mounting projection 101 is held tightly against the mounting post 15 to snugly hold the air silencer 31 on the crankcase cover 13 by the previously mentioned helical spring 149 which encircles the latch member 131 and which bears between the transverse end wall 119 of the cylindrical projection 115 of the second member 65 and the shoulder 147 formed on the latch member 131 between the adjacent portion 145 and the central portion 151 thereof.

To disassemble the air silencer 31 from the crankcase cover 13, the latch member 131 is depressed inwardly against the action of the spring 149 to release the engagement of the bayonet end 161 of the latch member 131 against the inner wall of the transverse opening 171 and thereby to enable rotation of the latch member 131 to a position enabling withdrawal of the bayonet end 161 from the mounting post 15 and, if desired, from the mounting assembly 113.

Attachment of the silencer 31 to the crankcase cover 13 of the engine block 11 involves the telescopic engagement of the openings 35 on the ends of the air induction tubes 23 and the insertion of the latch member 131 through the bayonet openings 109 and 121 in the mounting assembly and through the bayonet opening 173 in the mounting post 15, followed by partial rotation of the latch member 131 and release thereof to enable the spring 149 to hold the bayonet end 161 of the latch member 131 against the inner wall of the transverse opening 171 in the mounting post 15 and the air silencer 31 snugly against the end most surface of the mounting post 15.

It is believed that the effectiveness of the disclosed construction in eliminating or substantially reducing air intake noise is attributable to the relative close spacing of the inner ends of the inlet tubes 43 from the adjacent opposing wall of the second plenum, when combined with the diametric size and length of the air supply tubes. The number of air supply tubes to be employed is principally determined by the incoming air requirement.

various of the features of the invention are set forth in the following claims.

We claim:

1. An air silencer for supplying combustion air to the air intake tube of a carburetor, said silencer comprising a first member including a first portion partially defining a first plenum area and including an opening adapted to communicate with the air intake tube, a second portion partially defining a second plenum area and including a plurality of air supply tubes adapted to communicate with the atmosphere,. and a third portion connecting said first and second portions, and a second member fixed to said first member and including a first portion located in spaced relation to said first portion of said first member and defining a plenum area cooperating with said first plenum area to define therebetween a first plenum chamber, a second portion located in spaced relation to said second portion of said first member and defining a plenum area cooperating with said second plenum area to define therebetween a second plenum chamber, and a third portion extending between said first and second portions of said second member and cooperating with said third portion of said first member to define therebetween a narrow passage connecting said first and second plenum chambers.

2. An air silencer for supplying combustion air to the air intake tubes of a series of carburetors, said silencer comprising a housing including a first member including a first portion partially defining a first plenum area and including a series of openings adapted to communicate with the series air intake tubes, a first portion partially defining a second plenum area and including a plurality of air supply tubes adapted to communicate with the atmosphere, and a third portion connecting said first and second portions, and a second member fixed to said first member and including first portion located in spaced relation to said first portion of said first member and defining a plenum area cooperating with said first plenum area to define therebetween a first plenum chamber, a second portion located in spaced relation to said second portion of said first member and defining a plenum area cooperating with said second plenum area to define therebetween a second plenum chamber, and a third portion extending between said first and second portions of said second member and cooperating with said third portion of said first member to define therebetween a narrow passage connecting said first and second plenum chambers.

3. An air silencer in accordance with claim 2 wherein said first member includes a mating surface, and wherein said second member includes a mating surface engaging said mating surface as said first member.

4. An air silencer in accordance with claim 2 wherein said housing further includes a hollow projection extending through said narrow passage and including an outer end having therein an opening, and further including a latch member enterable into said hollow projection and through said opening and adapted to be engaged with a supporting member.

5. An air silencer comprising a main body including a first one-piece member including a first wall partially defining a first plenum area, a second wall partially defining a second plenum area, and a third wall connecting said first and second walls, and a second one-piece member including a first wall which partially defines a plenum area cooperating with said first plenum area of said first member to define a first plenum chamber, a second wall which partially defines a plenum area cooperating with said second plenum area of said first member to define a second plenum chamber, and a third wall which connects said first and second walls of said second member and which cooperates with said third wall of said first member to define therebetween a narrow passage between said first and second plenum chambers, said first and second members being secured together so that said first walls of said first and second members are located in spaced relation to each other to define therebetween said first plenum chamber, so that said second walls of said first and second members are located in spaced relation to each other to define therebetween said second plenum chamber, and so that said third walls of said first and second members are located in spaced relation to each other to define therebetween said narrow passage.

6. A silencer comprising a main body including a first member including a first wall partially defining a first plenum area, a second wall partially defining a second plenum area, a third wall connecting said first and second walls, and a hollow projection extending away from said first member and having an outer end with a hole therein, and a second member including a first wall which partially defines a plenum area cooperating with said first plenum area of said first member to define a first plenum chamber, a second wall which partially defines a plenum area cooperating with said second plenum area of said first member to define a second plenum chamber, a third wall which connects said first and second walls of said second member and is located in spaced relation to said third wall of said first member to define therebetween a narrow passage between said first and second plenum chambers, and a hollow extension telescoping into said hollow projection and having an outer end with an aperture registering with said hole in said hollow projection, and a latch member entering into said hollow extension and passing through said hole and said aperture.

7. A silencer in accordance with claim 6 wherein said second member also includes a plurality of inlet tubes having inner ends communicating with said second plenum chamber and spaced from said first wall at a distance of about ¼ of an inch.

8. A silencer in accordance with claim 7 wherein said third walls of said first and second members are spaced at a distance of about ¼ of an inch.

9. A silencer in accordance with claim 8 wherein said inlet tubes have a diameter of about ⅜ths of an inch and have a length of at least twice said diameter.

10. A silencer in accordance with claim 6 wherein said first wall of said first member includes a plurality of openings adapted to telescopingly engage the ends of a plurality of carbureator air induction tubes.

* * * * *